United States Patent [19]

Katz

[11] 3,990,461

[45] Nov. 9, 1976

[54] RAZOR CUT COMB BRUSH

[75] Inventor: Michael Katz, New York, N.Y.

[73] Assignee: Lawrence Peska Associates, Inc., New York, N.Y. ; a part interest

[22] Filed: June 11, 1975

[21] Appl. No.: 586,031

[52] U.S. Cl. ..... 132/85; 132/126

[51] Int. Cl.[2] ..... A45D 44/18

[58] Field of Search ..... 132/85, 120–121, 132/11, 126, 139, 142, 147–148

[56] References Cited

UNITED STATES PATENTS

| | | | |
|---|---|---|---|
| 660,893 | 10/1900 | Durgin | 132/120 |
| 1,654,117 | 12/1927 | Durlacher | 132/120 |
| 2,123,043 | 7/1938 | Hertzberg | 132/120 |
| 2,168,235 | 8/1939 | Oshman et al. | 132/121 |

FOREIGN PATENTS OR APPLICATIONS

| | | | |
|---|---|---|---|
| 552,091 | 11/1956 | Italy | 132/126 |

*Primary Examiner*—G.E. McNeill

*Attorney, Agent, or Firm*—Jack D. Slobod

[57] ABSTRACT

A razor cutting comb and brush includes a head portion having brush bristles on one side and plural spaced apart combs on the other side. A double edged razor blade cartridge including a pair of opposed cylindrical guide ribs and friction ribs directed perpendicular to the guide ribs is slideably carried in a pocket formed in the thickness of the head portion and retained in place by the friction ribs. Protrusions on the blade cartridge provide a grip for slideable adjusting the height of one of its blades along the brush bristles or the other of its blades between the combs.

1 Claim, 5 Drawing Figures

RAZOR CUT COMB BRUSH

FIELD OF THE INVENTION

The present invention relates generally to combined hair gathering and razor cutting devices. In its particular aspect the present invention relates to a hair grooming device having an oppositely directed comb and brush combined with a double edged cutter means slideable alongside either the brush bristles or comb teeth.

BACKGROUND OF THE INVENTION

Various razor cutting devices are known which hold a razor blade alongside short rigid hair gathering protrusions such as illustrated in U.S. Pat. No. 3,536,080 to Player. Hair cutting devices of the aforementioned type have not been sufficiently adaptable or adjustable for the cutting, trimming or thinning of hair into varied styles. Furthermore, in such devices, the blade therein is exposed on one side, increasing the possibility of an accidental cut.

OBJECTS OF THE INVENTION

It is an object of the present invention to provide a hair grooming device having both comb and brush members with a means for holding and adjusting the height of a razor blade within both the brush member and the comb member.

It is a further object of the present invention to provide a hair grooming device having a blade which is guarded on both sides by hair gathering members to prevent accidental cutting.

SUMMARY OF THE INVENTION

Briefly, the aforementioned and other objects of the present invention are satisfied by providing a hair grooming device having a head carrying brush bristles on one broad face and at least two rows of comb teeth on an opposite broad face. A pocket is formed in the thickness of the head which includes groove means for engaging guide ribs on a double edged blade cartridge to enable the blade to slide in the pocket in a direction perpendicular to the blade edges. The pocket intersects one broad face between rows of the bristles and the other broad face between rows of comb teeth. Projections on the blade provide a finger grip for adjustably sliding the blade in the pocket either in one direction between the rows of bristles, or in the other direction between the rows of comb teeth. The provision of spaced apart rows of bristles or teeth on both sides of the pocket, guard the blade as it is projected between rows with an adjustable height.

Other objects, features and advantages of the present invention will become apparent upon perusal of the following detailed description of the preferred embodiment of the present invention when taken in conjunction with the appended drawing wherein.

DETAILED DESCRIPTION

Figure 1:
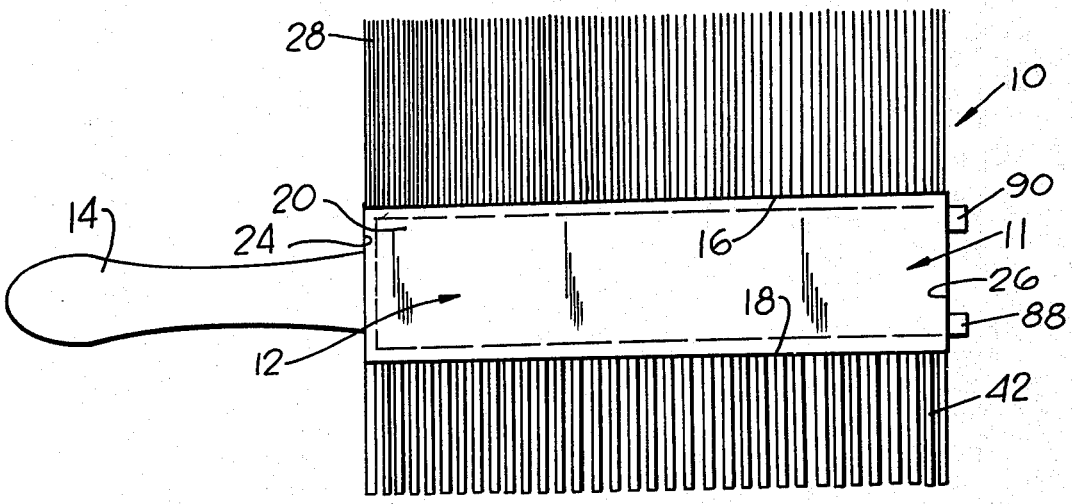
FIG. 1 is a side view of the hair grooming device of the present invention.

Referring to FIGS. 1 through 4 of the drawing, the hair grooming device 10 of the present invention comprises a support body 11 having an elongated head 12 and an elongated shaped handle 14 projecting therefrom. Head 12 is preferably generally shaped as a rectangular solid having opposed broad top and bottom faces 16 and 18, opposed elongated side surfaces 20 and 22, and opposed end surfaces 24 and 26. Handle 24 projects from end surface 24.

Figure 2:
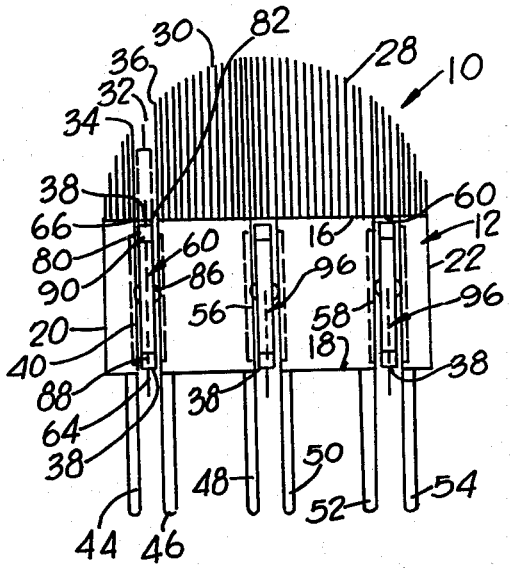
FIG. 2 is an end view from the right of FIG. 1.

A rectangular array of hair brush bristle members 28 are rooted into top face 16 and project perpendicularly therefrom. Preferably bristle members 28 are distributed generally throughout surface 16 and are tapered in length transversely of head 12 so that the longest bristles members are in the center of head 12 as viewed from the end of the head. As illustrated in FIG. 2, a preferable transverse tapering of the length of the bristle members 28 is where the free ends of the bristle members lie on a cylindrical curve 30.

A longitudinally directed strip 32 of surface 16 is left free of bristle members 28 and is bounded on its opposite sides by longitudinally directed rows 34 and 36 of bristle members 28. Strip 32 comprises one of a pair of elongated apertures 38 formed by the respective intersection of a vertical slot or pocket 40 through the thickness of head 12 with opposed surfaces 16 and 18.

Projecting perpendicularly from bottom surface 18 there is preferably provided six spaced apart longitudinally directed rows of generally cylindrical comb teeth 42. The six rows of comb teeth 42, which span the length of head 12, are labelled in FIG. 2 with the even numbers 44 through 54 inclusive. The comb tooth rows 44 and 46 are provided along opposite sides of the elongated aperture 38 formed on surface 18 by the intersection of pocket 40.

Parallel to pocket 40 a pair of transversely spaced apart vertically directed pockets 56 and 58 are formed in the thickness of head 12. Preferably pockets 56 and 58 do not reach surface 16 but are separated therefrom by thin wall sections 60. Pockets 56 and 58 intersect surface 18 in spaced apart elongated parallel apertures 38.

Figure 3:
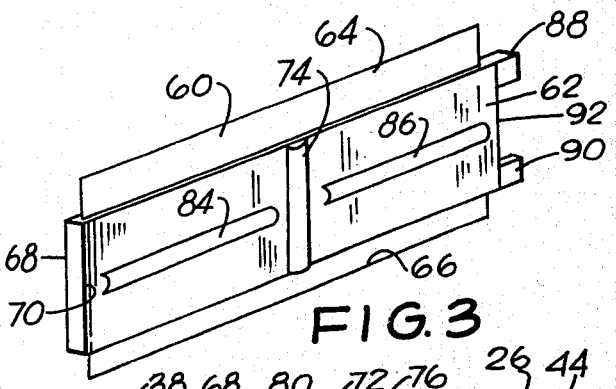
FIG. 3 is a pictorial presentation of a blade cartridge.
Figure 4:
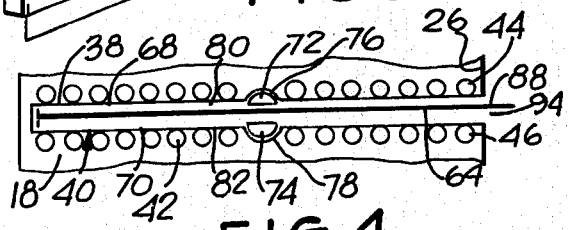
FIG. 4 is a partial bottom view of FIG. 1 showing the blade cartridge of FIG. 3 in place.

Within pocket 40 there is carried a double edged razor blade cartridge 60 illustrated in FIG. 3. Cartridge 60 includes an elongated rectangular carrier plate 62 from opposite sides of which project longitudinally elongated razor blade edges 64 and 66 in opposite directions. There is further provided generally centrally on the respective opposite planar faces 68 and 70 of carrier plate 62 a pair of elongated opposed ribs 72 and 74 of semi-circular cross-section. Ribs 72 and 74 are directed perpendicular to blade edges 64 and 66 and form guide rib means which are keyed into opposed vertically directed grooves 76 and 78 of semi-circular cross-section, formed in the respective longitudinally and vertically directed spaced apart parallel walls 80 and 82 defining pocket 40. Thus blade cartridge 60 is slideable in pocket 40 whereby blade edge 66 may be advanced upward between and alongside bristle rows 34 and 36 or blade edge 64 may be advanced downward between and alongside the comb members comprising the respective comb tooth rows 44 and 46.

For retaining the blade cartridge 60 in pocket 40, there is provided on each face 68 and 70 of plate 62 a pair of colinear ribs 84 and 86 on opposite sides of the respective ribs 72 and 74. Ribs 84 and 86, are directed parallel to blade edges 64 and 66 and project from faces 68 and 70 a sufficient distance to frictionally contact walls 80 and 82 of pocket 40.

To provide means for gripping cartridge 60, a pair of pegs 88 and 90 project from end wall 92 of carrier plate 62 and through a rectangular opening 94 in the end surface 26 of head 12 formed by the intersection of pocket 40 with the end wall. Thus cartridge 60 may be slid vertically either up or down along guide grooves 76 and 78, by gripping one of pegs 88 and 90. The blade edges 64 and 66 may thus be adjusted in height alongside either bristle members 28 or comb teeth 42. The cartridge 60 remains in place after adjustment by the frictional action of ribs 84 and 86.

To augment the cutting action of blade edge 64 between comb tooth rows 44 and 46, pocket 56 lies between comb tooth rows 48 and 50 and pocket 58 lies between comb tooth rows 52 and 54. Within each of the pockets 56 and 58 is a single edged blade cartridge 96 which is identical to cartridge 60 but with the omission of blade edge 66. Blade cartridges 96 are adapted to slide downward in pockets 56 and 58 to project the blades 64 at adjustable heights alongside comb teeth 44.

Hair is directed serially through the edges of the three blades carried in pockets 40, 56 and 58 to make various new cutting techniques possible by setting each blade at a different height.

Figure 5:
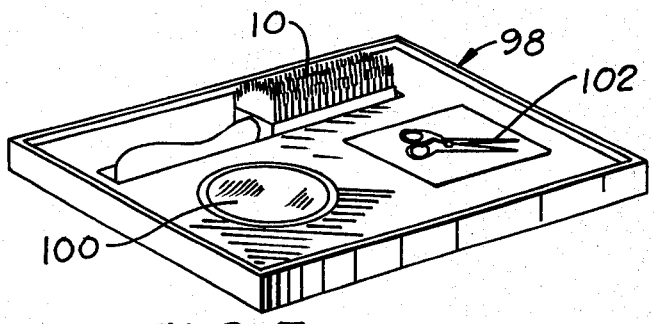
FIG. 5 is a pictorial presentation of a kit including the hair grooming device of the present invention.

Referring to FIG. 5, the hair grooming device 10 may be provided in a rectangular holder 98 for device 10 and other related items such as a circular mirror 100 and scissors 102. Preferably the back side of mirror of 100 is provided with a suction cup (not shown) to enable the mirror to be secured to a shower stall wall to facilitate the use of device 10 in the shower. Preferably also a fine mesh screen (not shown) is also included in the kit carried by holder 98 to be placed over the shower drain for collecting cut hair.

Having described the preferred embodiment of the present invention in great detail, it should be apparent that numerous modifications, additions and omissions in the details thereof are possible within the intended spirit and scope of the invention. Accordingly, the following claims define the scope of the invention.

What is claimed is:

1. A hair groming device comprising: a head portion; a handle portion connected to said head portion; brush bristle means and comb tooth means respectively projecting from said head portion in opposite directions; said comb tooth means comprising two parallel rows of comb teeth; pocket means formed in said head portion; said pocket means communicating from alongside said bristle means to between said two rows of comb teeth, cutter means slideable mounted in said pocket means; said cutter means having oppositely directed blades respectively adapted to project alongside said brush means and between said rows of comb teeth; and grip means projecting out of said pocket means from said cutter means for slideably adjusting the position of said cutter means in said pocket means.

* * * * *